US010932039B2

(12) United States Patent
Zheng et al.

(10) Patent No.: US 10,932,039 B2
(45) Date of Patent: Feb. 23, 2021

(54) SPEAKER BOX

(71) Applicant: AAC Acoustic Technologies (Shenzhen) Co., Ltd., Shenzhen (CN)

(72) Inventors: Yajian Zheng, Shenzhen (CN); Lu Feng, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/686,238

(22) Filed: Nov. 18, 2019

(65) Prior Publication Data

US 2020/0162812 A1 May 21, 2020

(30) Foreign Application Priority Data

Nov. 19, 2018 (CN) ..... 201821905875.6

(51) Int. Cl.

| | |
|---|---|
| ***H04R 1/34*** | (2006.01) |
| ***H04R 1/02*** | (2006.01) |
| ***H04R 7/16*** | (2006.01) |
| ***H04R 7/12*** | (2006.01) |

(52) U.S. Cl.

CPC ..... *H04R 1/345* (2013.01); *H04R 1/025* (2013.01); *H04R 7/12* (2013.01); *H04R 7/16* (2013.01); *H04R 2499/11* (2013.01)

(58) Field of Classification Search

CPC ..... H04R 1/02; H04R 1/025; H04R 1/2083; H04R 1/2807; H04R 1/2811; H04R 1/2815; H04R 1/2819; H04R 1/2823; H04R 1/2826; H04R 1/2834; H04R 1/28345; H04R 1/2842; H04R 7/12; H04R 7/16; H04R 2499/11

USPC ..... 381/334, 335, 337, 338, 339, 345, 350, 381/351

See application file for complete search history.

(56) References Cited

U.S. PATENT DOCUMENTS

| | | | | |
|---|---|---|---|---|
| 3,142,353 A * | 7/1964 | Todisco | H04R 1/2826 181/145 |
| 5,189,706 A * | 2/1993 | Saeki | H04R 1/2826 181/155 |
| 5,197,103 A * | 3/1993 | Hayakawa | H04R 1/02 181/148 |
| 8,885,867 B1 * | 11/2014 | Tai | H04R 1/403 381/388 |
| 9,241,207 B2 * | 1/2016 | Wang | H04R 1/2842 |
| 9,838,765 B1 * | 12/2017 | Li | H04R 1/288 |
| 10,225,646 B2 * | 3/2019 | Qin | H04R 1/2888 |
| 10,412,484 B2 * | 9/2019 | Je | H04R 1/345 |

(Continued)

*Primary Examiner* — Xu Mei

(74) *Attorney, Agent, or Firm* — W&G Law Group LLP

(57) ABSTRACT

The present invention provides a speaker box, includes a housing having an accommodating space, a speaker unit accommodated in the accommodating space of the housing, and two sound channels formed in the accommodating space. The speaker unit includes a diaphragm that vibrates for generating sound. The diaphragm divides the accommodating space into a front sound cavity and a rear cavity. The sound channel communicates the front sound cavity with an outside. The sound channel is connected with the front sound cavity to form a front cavity. The sound channel respectively communicates the front sound cavity with the outside. The two sound channels are symmetrically disposed on opposite sides of the speaker unit respectively.

4 Claims, 3 Drawing Sheets

(56) References Cited

U.S. PATENT DOCUMENTS

| | | | | |
|---|---|---|---|---|
| 10,674,250 | B2 * | 6/2020 | Wang | H04R 1/025 |
| 2007/0297629 | A1 * | 12/2007 | Gelbart | H04R 1/345<br>381/351 |

* cited by examiner

SPEAKER BOX

TECHNICAL FIELD

The present disclosure relates to an electro acoustic field, and in particular to a speaker box for portable electronic products.

BACKGROUND

With the advent of mobile internet era, the number of smart mobile devices continues to rise. Among many mobile devices, mobile phones are undoubtedly the most common and portable mobile terminal devices. At present, functions of the mobile phones are extremely diverse, one of which is high-quality music functions, so a speaker box for playing sound is widely used in today's smart mobile devices.

The speaker box in the prior art comprises a housing having an accommodating space, a speaker unit accommodated in the housing, and a sound channel formed in the accommodating space. The speaker unit comprises a diaphragm that vibrates for generating sound. The diaphragm divides the accommodating space into a front sound cavity and a rear cavity. The sound channel communicates with the front sound cavity with an outside. The sound channel communicates with the front sound cavity to form a front cavity.

However, in the prior art, the sound channel of the speaker box is designed to be single, and a structure for emitting sound is formed on one side of the speaker unit. Since airflow of the front sound cavity needs to enter the sound channel from the same side of the speaker unit, airflow in the front cavity is easily unbalanced, which cause the swing amplitude of the diaphragm to be excessive during vibration, which affects reliability and acoustic performance of the speaker box.

Therefore, it is necessary to provide a speaker box to solve above technical problems.

BRIEF DESCRIPTION OF DRAWINGS

In order to more clearly illustrate technical solutions in embodiments of the present disclosure, the drawings used in the description of the embodiments will be briefly described below. Apparently, the drawings in the following description are merely some of the embodiments of the present disclosure, and those skilled in the art are able to obtain other drawings according to the drawings without contributing any inventive labor. In the drawing.

DETAILED DESCRIPTION OF THE EXEMPLARY EMBODIMENT

The technical solutions in the embodiments of the present disclosure will be clearly and completely described in conjunction with the drawings in the embodiments of the present disclosure. It is obvious that the described embodiments are only a part of the embodiments of the present disclosure, and not all of them. All other embodiments obtained by those skilled in the art based on the embodiments of the present disclosure without creative efforts are within the scope of the present disclosure.

Figure 1:
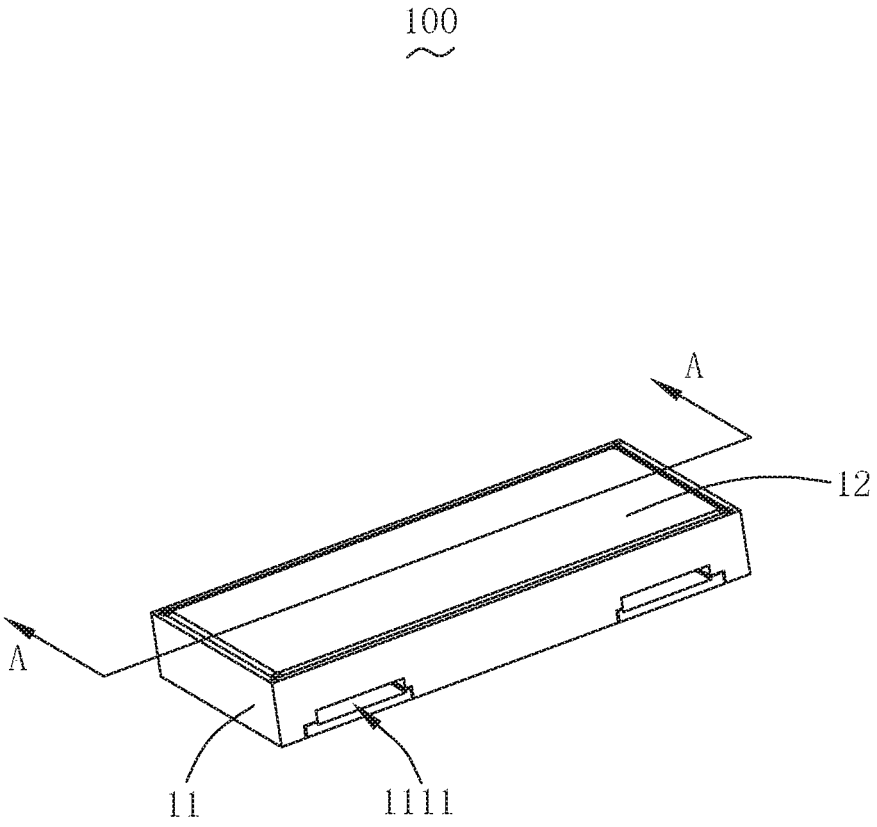
FIG. 1 is a schematic perspective view of a speaker box according to the present disclosure.
Figure 2:
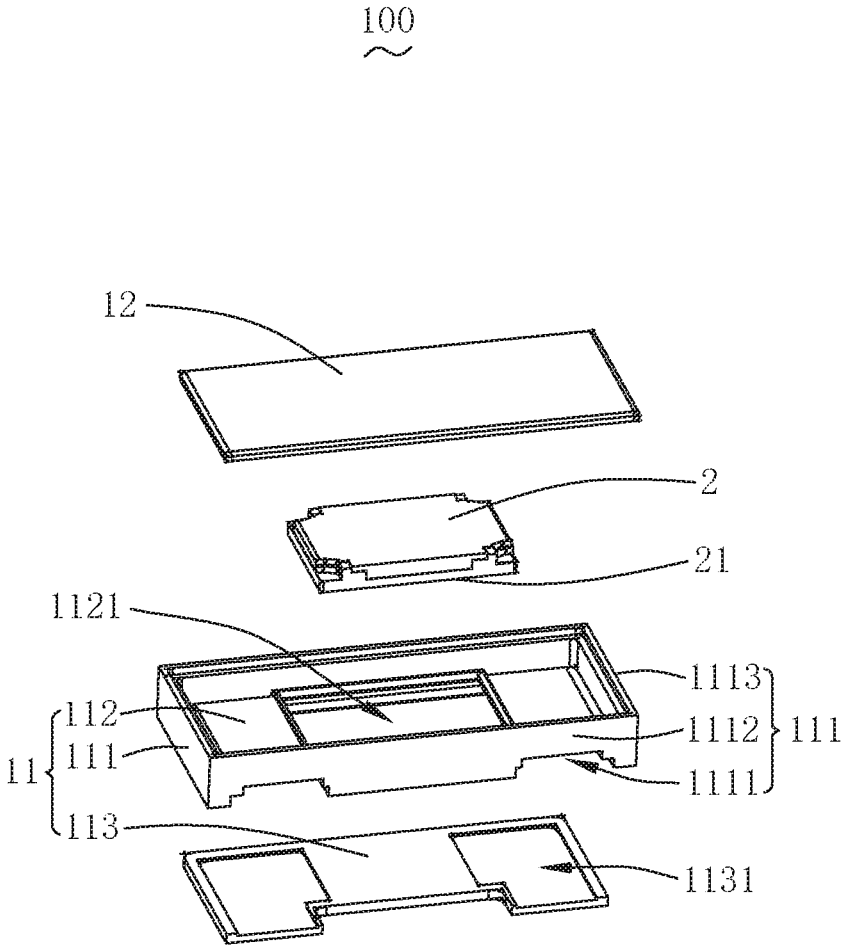
FIG. 2 is an exploded perspective view showing a portion of the speaker box of the present disclosure.

As shown in FIGS. 1-2, the present disclosure provides a speaker box 100. The speaker box 100 includes a housing 1 and a speaker unit 2.

Figure 3:
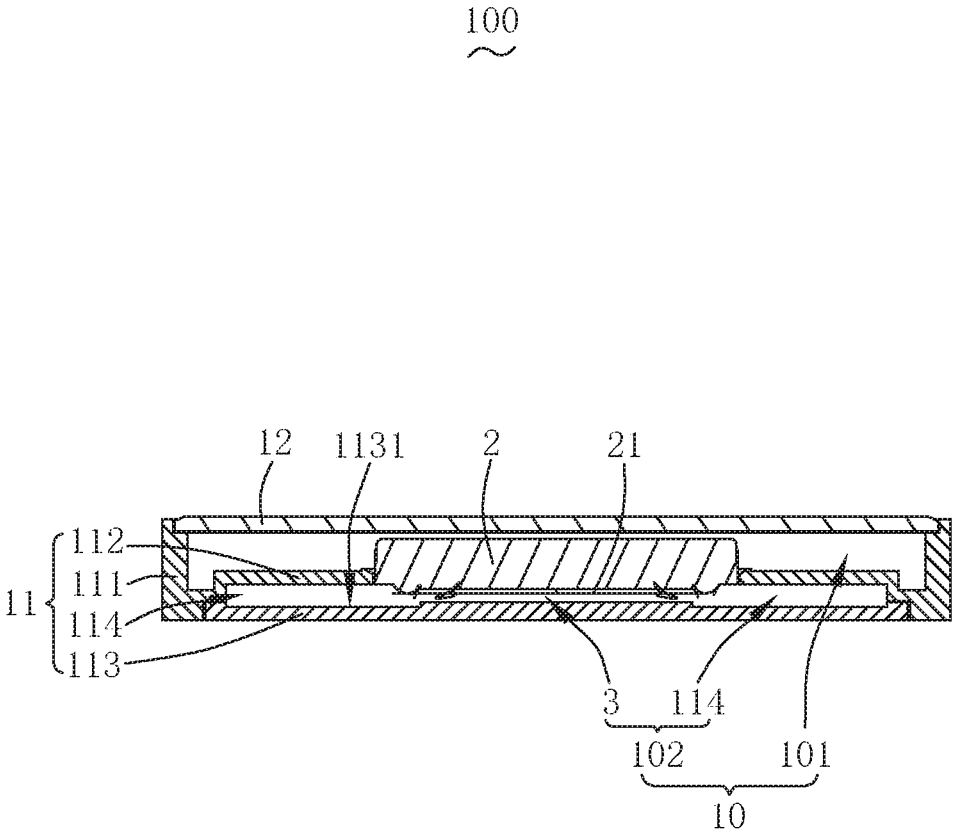
FIG. 3 is a cross-sectional view taken along a line A-A shown in FIG. 1.

As shown in FIGS. 1-3, the housing 1 includes an accommodating space 10. The housing 1 may be integrally formed as one part or assembled with separate parts. In the embodiment, the housing 1 is assembled with separate parts. Specifically, the housing 1 includes an upper cover 11, and a lower cover 12 covered on the upper cover 11 to cooperatively form the accommodating space 10.

The upper cover 11 includes an annular side wall 111, a separating plate 112 connected with an inner side of the side wall 111, and an upper cover plate 113 disposed on an end of the side wall 111 and spaced apart from the separating plate 112. An interval between the upper cover plate 113 and the separating plate forms sound channels 114.

Furthermore, at least two sound holes 1111 penetrating through the side wall 111 are disposed on the side wall 111. The separating plate 112 comprises an accommodating hole 1121 penetrating through the separating plate 112. A side of the upper cover plate 113 close to separating plate 112 is recessed to form two retaining grooves 1131. Of course, the upper cover 11 may be integrally formed as one part.

In the embodiment, the speaker box 100 is of a rectangular shape. The side wall 111 comprises two long side walls 1112 parallel to a long axis and two short side walls 1113 parallel to a short axis. The two long side walls 1112 are disposed opposite to each other. The two short side walls 1113 are disposed opposite to each other. It should be noted that the shape of the speaker box is not limited to this.

The speaker unit 2 is accommodated in the accommodating space 10 of the housing 1. The speaker unit 2 divides the accommodating space 10 into a front sound cavity 3 and a rear cavity 101.

In the embodiment, the speaker unit 2 includes a diaphragm 21 that vibrates for generating sound. The diaphragm 21 divides the accommodating space 10 into the front sound cavity 3 and a rear cavity 101. To be specific, the speaker unit 2 is clamped and fixed in the accommodation hole 1121. And an interval between the diaphragm 21 and the upper cover plate 113 is formed to produce the front sound cavity 3.

The lower cover 12 is fixed on another end of the side wall 111 and spaced apart from the separating plate 112. The lower cover 12 and the upper cover plate 113 are disposed on opposite sides of the side wall 111. The lower cover 12, the side wall 111, the separating plate 112, and the speaker unit 2 are enclosed together to form the rear cavity 101. The rear cavity 101 is configured for improving low frequency acoustic performance of the speaker box 100.

The upper cover plate 113 is disposed on the side wall 111 and is spaced apart from the separating plate 112 to form the sound channels 114. That is, the upper cover plate 113, the side wall 111, and the separating plate 112 are enclosed together to form the sound channels 114.

The sound channels 114 communicate the front sound cavity 3 with the outside, and the sound channels 114 communicate with the front sound cavity 3 to form a front cavity 102. The sound channels 114 form a side sounding structure.

In the embodiment, the speaker box 100 has two sound channels 114. The two sound channels respectively communicate the front sound cavity with the outside. To be specific, the two sound channels 114 respectively communicate with the two sound holes 1111 disposed on the side wall 111, thus, the front sound cavity 3 communicates with the outside.

Furthermore, the two sound holes 1111 are disposed on one of the long side walls 1112, which realizes side sound of the speaker box 100 and facilitates an installation structure design on a terminal. Further, such structure maximizes a sound guiding area of the sound channels 114 and improves a sounding effect.

The two sound channels 114 are respectively symmetrically disposed on opposite sides of the speaker unit 2, which forms a symmetric distribution structure of double sound channels. Thus, airflow in the front cavity 102 is well balanced, an amplitude of oscillation of the diaphragm 21 during a vibration process is effectively suppressed, and reliability of the speaker box 100 is improved. In addition, an arrangement of the two sound channels 114 makes sounding airflow of the front sound cavity 3 smoother, thereby improving an acoustic performance of the speaker box 100.

To be specific, portions of the separating plate 112 disposed on the opposite sides of the speaker unit 2 are respectively spaced apart from the upper cover plate 113 to form the two sound channels 114.

The two retaining grooves 1131 of the upper cover plate 113 are respectively disposed corresponding to the two sound channels 114, which effectively increases a sounding area of the sound channels 114, makes the sounding airflow of the front sound cavity 3 smoother, and improves the acoustic performance of the speaker box 100.

Compared with the prior art, in the speaker box of the present disclosure, the upper cover plate of the upper cover is spaced apart from the separating plate such that portions of the separating plate disposed on opposite sides of the speaker unit and the upper cover are enclosed together to form the two sound channels. The speaker unit is spaced apart from the upper cover plate to form the front sound cavity, and the two sound channels are symmetrically disposed on opposite sides of the speaker unit and respectively communicate with the front sound cavity, which realizes the side sounding structure of the double sound channels. Symmetrical distribution design of the two sound channels makes the airflow in the front cavity more balanced, which effectively suppress the amplitude of the oscillation of the diaphragm during the vibration process, and improves the reliability of the speaker box. In addition, the structure of the two sound channels makes the sounding airflow of the front sound cavity smoother and improves the acoustic performance of the speaker box.

The above is only the embodiments of the present disclosure, and it should be noted that those skilled in the art can make improvements without departing from the concept of the present disclosure, which are all within the scope of the present disclosure.

What is claimed is:

1. A speaker box, comprising:

a housing having an accommodating space, a speaker unit accommodated in the accommodating space of the housing; and two sound channels formed in the accommodating space; wherein, the speaker unit comprises a diaphragm that vibrates for generating sound; the diaphragm dividing the accommodating space into a front sound cavity and a rear cavity; the two sound channels respectively communicates the front sound cavity with an outside; the two sound channels communicates with the front sound cavity to form a front cavity; and the two sound channels are symmetrically disposed on opposite sides of the speaker unit respectively;

the housing comprises an upper cover and a lower cover disposed on the upper cover to form the accommodating space;

the upper cover comprises an annular side wall, a separating plate connected with an inner side of the side wall, and an upper cover plate disposed at an end of the side wall and spaced apart from the separating plate;

the separating plate comprises an accommodating hole penetrating through the separating plate; the speaker unit is clamped and fixed in the accommodation hole; and an interval between the diaphragm and the upper cover plate is produced to form the front sound cavity, portions of the separating plate disposed on opposite sides of the speaker unit are respectively spaced apart from the upper cover plate to form the two sound channels;

the lower cover is fixed on another end of the side wall and spaced apart from the separating plate;

the lower cover, the side wall, the separating plate, and the speaker unit are enclosed together to form the rear cavity.

2. The speaker box according to the claim 1, wherein a side of the upper cover plate close to separating plate is recessed to form two retaining grooves;

the two retaining grooves are respectively disposed corresponding to the two sound channels.

3. The speaker box according to the claim 1, wherein at least two sound holes penetrating through the side wall are disposed on the side wall;

the two sound channels respectively communicates with the two sound holes.

4. The speaker box according to the claim 3, wherein the speaker box is of a rectangular shape;

the side wall comprises two long side walls parallel to a long axis and two short side walls parallel to a short axis;

two long side walls are disposed opposite to each other;

two short side walls are disposed opposite to each other; and two sound holes are disposed on one of the long side walls.

* * * * *